US006223834B1

(12) United States Patent
Takamura et al.

(10) Patent No.: US 6,223,834 B1
(45) Date of Patent: May 1, 2001

(54) IMPACT STRUCTURE FOR IMPACT POWER TOOL

(75) Inventors: Akio Takamura; Yasuhiro Takarayama; Kouki Morimoto, all of Fuchu (JP)

(73) Assignee: Ryobi Limited, Fuchu (JP)

( * ) Notice: Subject to any disclaimer, the term of this patent is extended or adjusted under 35 U.S.C. 154(b) by 0 days.

(21) Appl. No.: 09/315,956

(22) Filed: May 21, 1999

(30) Foreign Application Priority Data

May 25, 1998 (JP) ..... 10-143424
Aug. 27, 1998 (JP) ..... 10-241650

(51) Int. Cl.[7] ..... B25D 15/00

(52) U.S. Cl. ..... 173/93.5; 173/93; 173/93.6; 173/211

(58) Field of Search ..... 173/93, 93.5, 93.6, 173/210, 211, 109, 117, 176, 178, 205; 81/467

(56) References Cited

U.S. PATENT DOCUMENTS 3,331,452 * 7/1967 Wanner ..... 173/93
3,835,934 * 9/1974 Schoeps et al. ..... 173/176
4,811,797 * 3/1989 Antipov et al. ..... 173/93
5,289,885 * 3/1994 Sakoh ..... 81/467
5,544,710 * 8/1996 Groshans et al. ..... 173/93.5
5,706,902 * 1/1998 Eisenhart ..... 173/93.5
5,936,403 * 11/1998 Putney et al. ..... 173/93.5
5,992,538 * 11/1999 Marcengill et al. ..... 173/93

FOREIGN PATENT DOCUMENTS 1-170570 U 12/1989 (JP) .

* cited by examiner

*Primary Examiner*—Scott A. Smith
(74) *Attorney, Agent, or Firm*—Oliff & Berridge, PLC.

(57) ABSTRACT

An impact structure for an impact power tool comprises: a hammer body rotatable by means of a driving actuator, and having at least one pawl member having an impact contacting area; and an operation body for rotating a bit for the impact power tool, having at least one wing member having an impact contacting area, which can be brought into contact with the impact contacting area of the pawl member. The operation body is rotated by intermittently hitting the pawl member of the hammer body against the wing member of the operation body in a rotational direction of the hammer body. The impact contacting area of the pawl member can be brought into point-contact or line-contact with the impact contacting area of the wing member.

12 Claims, 9 Drawing Sheets

IMPACT STRUCTURE FOR IMPACT POWER TOOL

BACKGROUND OF THE INVENTION

1. Field of the Invention

The present invention relates to an impact structure for an impact power tool, in which an operation body can be rotated by imparting an impact force to the operation body by means of a hammer body.

2. Description of the Related Art

There has been known an impact power tool as a power tool for fastening or unfastening a bolt. In such an impact power tool, an operation body is rotated by intermittently hitting a pawl member of a hammer body, which is rotated by means of a driving actuator such as an electric motor, against a wing member of the operation body in the rotational direction of the hammer body.

The conventional impact power tool has at least two pawl members and at least two wing members, which are disposed at proper positions so as to cause the simultaneous impact contact of the pawl members with the wing members, as described for example in Japanese Utility Model Provisional Publication No. H1-170,570). The impact contacting areas of the pawl member and the wing member are formed into a flat surface so that they are brought into surface contact with each other.

However, in the conventional impact power tool, in which the impact contacting areas of the pawl member and the wing member are formed into the flat surface so that they are brought into surface contact with each other for imparting impact force to the operation body, the transmission of the impact force is conducted through the entirety of the impact contacting area of the pawl member. As a result, the dispersion of force easily occurs due to the flat surface of the pawl member, thus making it impossible to transmit the sufficient driving torque to the operation body. Using a large-sized hammer body can solve the problem. In this case, it is however necessary to make the operation body also in a large size in order to ensure its strength. Accordingly, the product as the impact power tool becomes large and heavy, thus degrading its maneuverability.

It is very hard to cause the simultaneous impact contact of all the pawl and wing members. When there is a small error in production, all the pawl members cannot simultaneously be brought into contact with the corresponding wing members, making a noise.

SUMMARY OF THE INVENTION

An object of the present invention is therefore to provide an impact structure for an impact power tool, which permits to generate sufficient fastening torque without changing the size of the impact power tool and to suppress the occurrence of noise.

In order to attain the aforementioned object, an impact structure for an impact power tool of the present invention comprises:

a hammer body rotatable by means of a driving actuator, said hammer body having at least one pawl member having an impact contacting area; and an operation body for rotating a bit for the impact power tool, said operation body having at least one wing member having an impact contacting area, which can be brought into contact with said impact contacting area of said pawl member;

said operation body being rotated by intermittently hitting said pawl member of said hammer body against said wing member of said operation body in a rotational direction of said hammer body;

wherein:

said impact contacting area of said pawl member can be brought into point-contact or line-contact with said impact contacting area of said wing member.

The pawl member is preferably hit against the wing member at a position corresponding to radius of gyration of the hammer body.

In addition to the above-mentioned optional, the pawl member is further preferably hit against the wing member at a position corresponding to a node of oscillation mode of the wing member.

At least one of the pawl member and the wing member may comprise a contact piece having the impact contacting area and a base part to which the contact piece is to be fixed, and the contact piece may be detachable from the base part.

At least one of the pawl member and the wing member may have a shock-absorbing member.

DETAILED DESCRIPTION OF THE PREFERRED EMBODIMENTS

Now, embodiments of an impact structure for an impact power tool of the present invention will be described in detail below with reference to the accompanying drawings.

Figure 1:
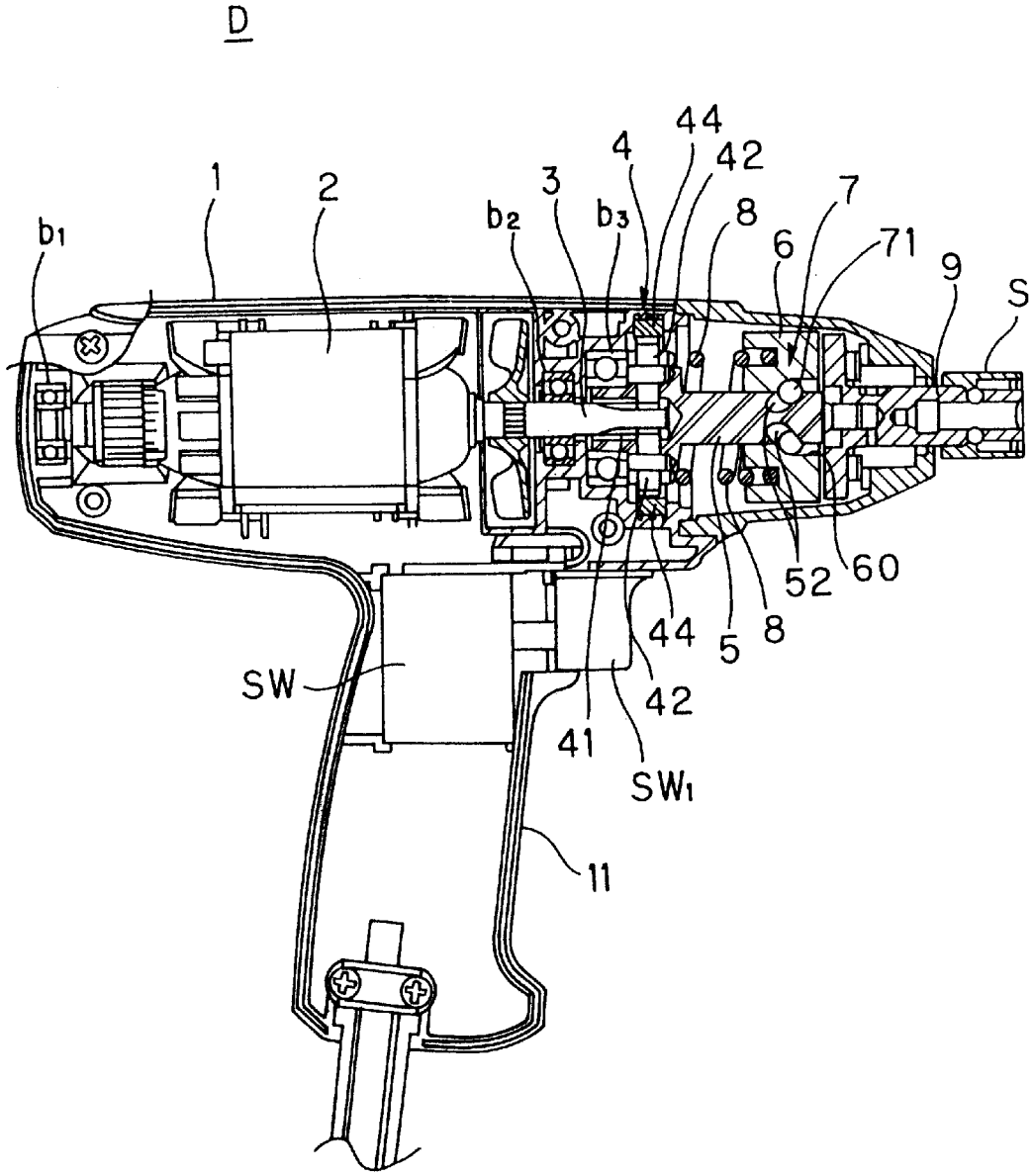
FIG. 1 is a cross-sectional view illustrating the entirety of an impact driver having an impact structure of the present invention.
Figure 2:
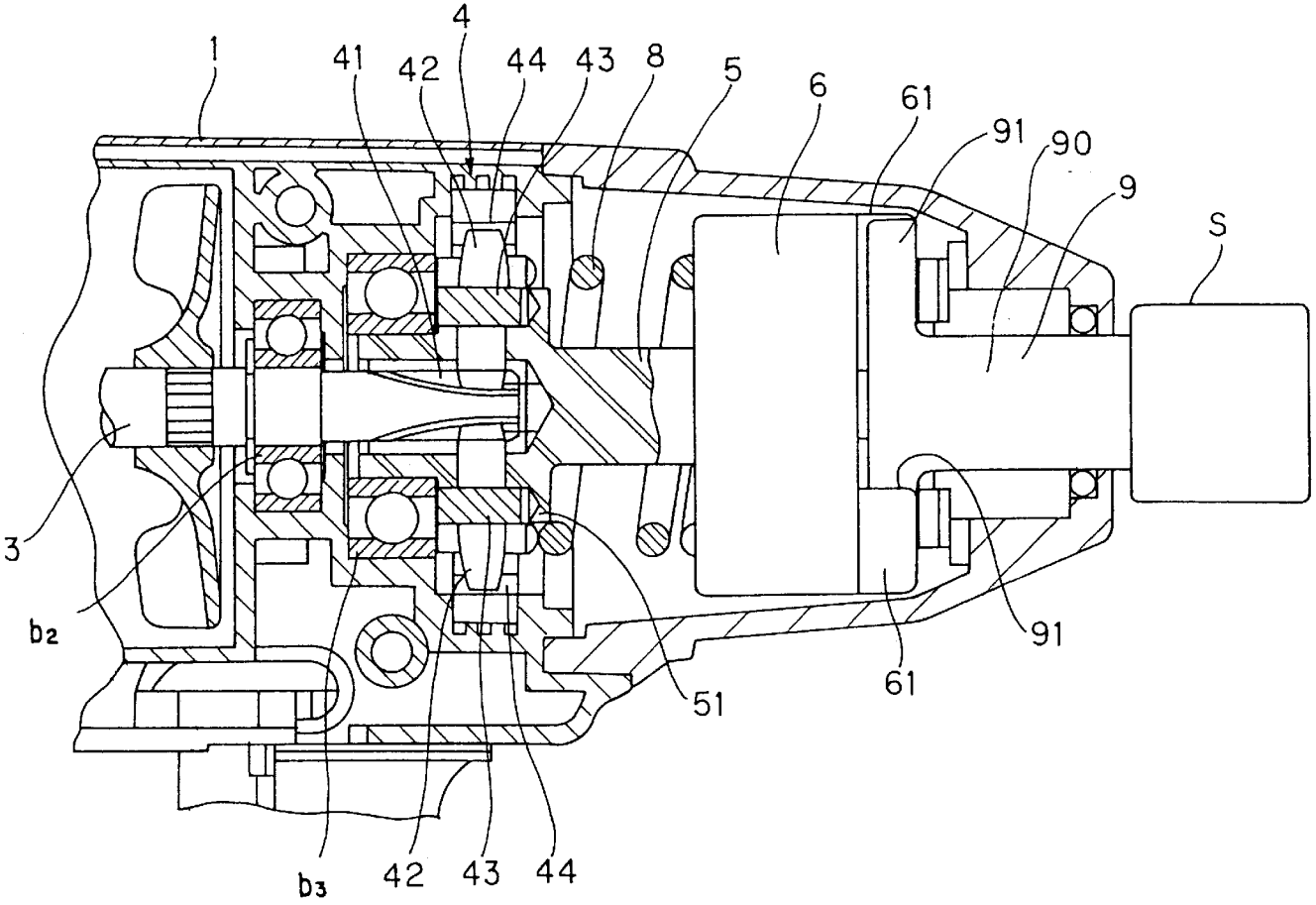
FIG. 2 is an enlarged partial cross-sectional view of the front portion of the impact driver as shown in FIG. 1.

FIGS. 1 and 2 are cross-sectional views of an impact driver D having an impact structure of the present invention. A casing 1, which defines the contours of the impact driver D, has a handgun shape. The casing 1 has a grip portion 11 provided with an operation switch SW. Holding the grip portion 11 and pulling the operation trigger SW1 of the switch SW by means of a finger can operate the impact driver D.

The impact driver D is provided in its inside and rear zone with an electric motor 2 serving as a driving actuator. There is disposed in front of the electric motor 2 a reduction mechanism 4, which permits transmission of rotation of the electric motor 2 at a prescribed reduction ratio. The rotational power is transmitted to a shaft 5 by means of the reduction mechanism 4. The shaft 5 is provided on its peripheral portion with a hammer body 6. A bit holder 9 is disposed in the front portion (i.e., the right-hand side of FIG. 1) of the casing 1. The bit holder 9 has at its tip end a socket S for holding a driver bit, a drill bit or the like.

The electric motor 2 has a rotational shaft 3 serving as an input shaft. The rotational shaft 3 is rotatably supported on the casing 1 by means of bearings b1, b2.

A pinion 41 is fixed to the tip end of the rotational shaft 3. The pinion 41 is placed in the central portion of the reduction mechanism 4. The reduction mechanism 4 includes the pinion 41; planetary gears 42, 42 engaged with the pinion 41 so as to rotate around it; and an internal gear 44, which is secured on the inner surface of the casing 1 and has on its inner surface the gear teeth with which the planetary gears 42, 42 engage. The planetary gears 42, 42 are received in a carrier portion 51 of the shaft 5. Pins 43, 43 serving as central axes for the planetary gears 42, 42 are supported on the carrier portion 51 of the shaft 5. The shaft 5 rotates together with the planetary gears 42, 42.

The shaft 5 is formed substantially into a cylindrical shape. The carrier portion 51 is formed as a flange, which locates in the intermediate portion of the shaft 5 in the axial direction thereof (i.e., the horizontal direction in FIG. 1). The shaft 5 has in its front portion (i.e., the right-hand side in FIG. 1) a cam groove 52 over the entire peripheral surface of the shaft 5. The shaft 5 is supported, at its portion locating behind the carrier portion 51, on the casing 1 by means of a bearing b3.

The hammer body 6 is provided on the outer periphery of the portion of the shaft 5 locating in front of the carrier portion 51 thereof, through a cam mechanism 7. The hammer body 6 is formed into a doughnut-shape. The hammer body 6 has on its front-end pawl members 61, 61 for transmitting the rotational motion to the bit holder 9, as shown in FIG. 2. The cam mechanism 7 has a cam groove 52 formed on the outer peripheral surface of the shaft 5; a counter-cam groove 60 formed on the inner peripheral surface of the hammer body 6; and steel balls 71, 71 disposed between the cam groove 52 and the counter-cam groove 60. The cam mechanism 7 has functions of rotating the hammer body 6 as well as converting the rotational motion of the shaft 5 into the linear motion of the hammer body 6, in which the hammer body 6 can move rearward (i.e., the left-hand direction in FIG. 1). The hammer body 6 is urged at its rear end by means of a spring 8. When the fastening torque reaches the prescribed value, the hammer body 6 moves in the left-hand direction in FIG. 2 against the resilient force of the spring 8. Such movement of the hammer body 6 causes increase in resilient force of the spring 8 so that the hammer body 6 can move forward (i.e., the right-hand direction in FIG. 1) to hit the bit holder 9. During such a hitting process, the hammer body 6 makes a reciprocating motion in the axial direction of the shaft 5, while rotating together with the shaft 5.

The impact driver D is provided at its front portion with the bit holder 9. The bit holder 9 has a holder body 90 formed into a cylindrical shape. A socket-mounting portion is provided at the front end of the holder body 90. The socket S for receiving a tool bit is mounted on the socket-mounting portion. The bit holder 9 is provided on its rear end with two wing members 91, 91, which are formed into a flat plate. The wing members 91, 91 extend in a radius direction so as to be symmetrical with respect to the center of the bit holder 9. The bit holder 9 has at a central portion of its rear end surface an inserting hole to which the front end of the shaft 5 can be inserted so that the bit holder 9 is rotatable relative to the shaft 5.

Figure 3:
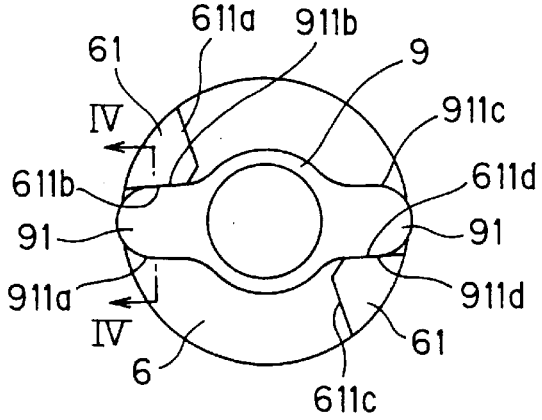
FIG. 3 is a view illustrating an embodiment in which an impact contacting area of a wing member of a bit holder is formed into a curved shape.
Figure 4:
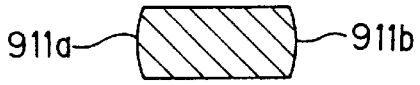
FIG. 4 is a cross-sectional view illustrating the wing member of the bit holder as shown in FIG. 3.

According to the impact driver D having the above-described structure, the forward movement of the hammer body 6 causes the pawl members 61, 61 of the hammer body 6 to be hit against the side portion of the wing members 91, 91 of the bit holder 9 so as to rotate the bit holder 9. With reference to FIGS. 3 and 4, description will be given of the structure of the impact bodies, which are composed of the pawl members 61, 61 of the hammer body 6 and the wing members 91, 91 of the bit holder 9.

FIG. 3 is a view illustrating the impact bodies, having a viewpoint located in the front side in the axial direction of the impact bodies. Embodiments in shape of the pawl members 61, 61 and the wing members 91, 91 are shown in FIG. 3. In FIG. 3, the pawl members 61, 61 and the wing members 91, 91 are in their hitting condition.

The pawl members 61, 61 are formed on the front-end surface of the hammer body 6 so as to symmetrical with respect to the center of the hammer body 6. Each of the two pawl members 61, 61 has a fan-shape tapering off to its inside end directing toward the center of the hammer body 6. Impact contacting areas 611*a*, 611*b*, 611*c*, and 611*d* provided on the both sides of the pawl members 61, 61 are formed into a flat surface. The impact contacting area 611*a* of the one pawl member 61 is in parallel with the impact contacting area 611*c* of the other pawl member 61, which locates so as to be symmetrical to the one pawl member 61 with respect to the center of the hammer body 6. The impact contacting area 611*b* and the impact contacting area 611*d* are also in parallel with each other in the same manner as mentioned above.

The wing members 91, 91 extend in a radius direction of the bit holder 9. Impact contacting areas 911*a*, 911*b*, 911*c*, 911*d* are provided on the both sides of the wing members 91, 91. These areas are curved on an imaginary plane perpendicular to the axial line of the bit holder 9 and are also curved on an imaginary plane for cutting the wing members 91, 91, which plane is in parallel with a plane including the axial line of the bit holder 9 (see FIG. 4). The wing members 91, 91 have a positional structure that the respective peaks of the impact contacting areas 911*b*, 911*d* can simultaneously hit the corresponding central portions of the impact contacting areas 611*b*, 611*d* at the respective single point. When the electric motor 2 operates in the rotational direction opposite to that mentioned above, the respective peaks of the impact contacting areas 911*b*, 911*d* can also simultaneously hit the corresponding central portions of the impact contacting areas 611*b*, 611*d* at the respective single point in the same manner as mentioned above.

Figure 5:
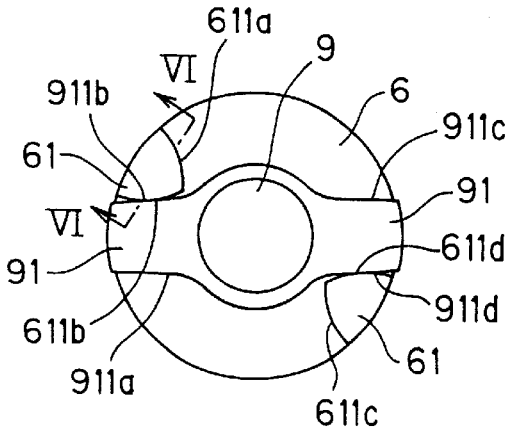
FIG. 5 is a view illustrating an embodiment in which an impact contacting area of a pawl member of a hammer body is formed into a curved shape.
Figure 6:
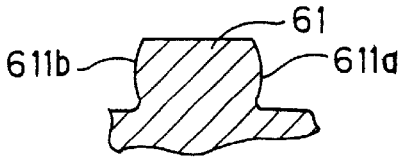
FIG. 6 is a cross-sectional view illustrating the pawl member of the hammer body as shown in FIG. 5.
Figure 7:
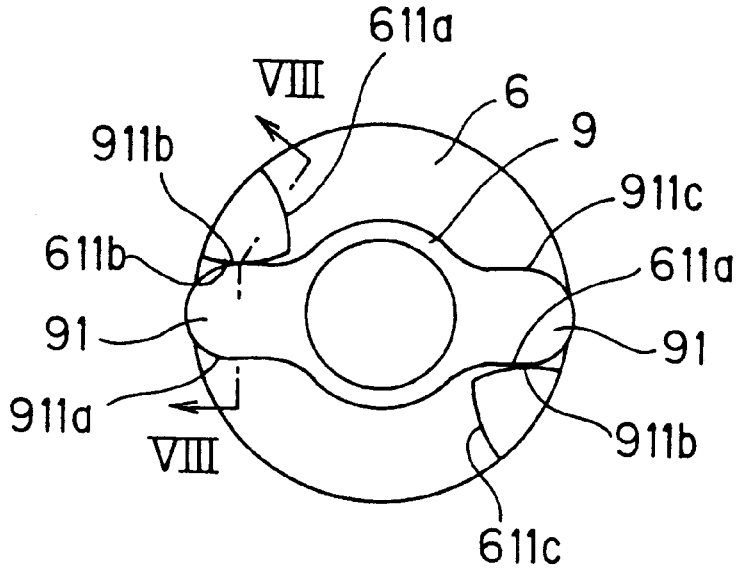
FIG. 7 is a view illustrating an embodiment in which the both of the impact contacting areas of the wing member and the pawl member are formed into a curved shape.
Figure 8:
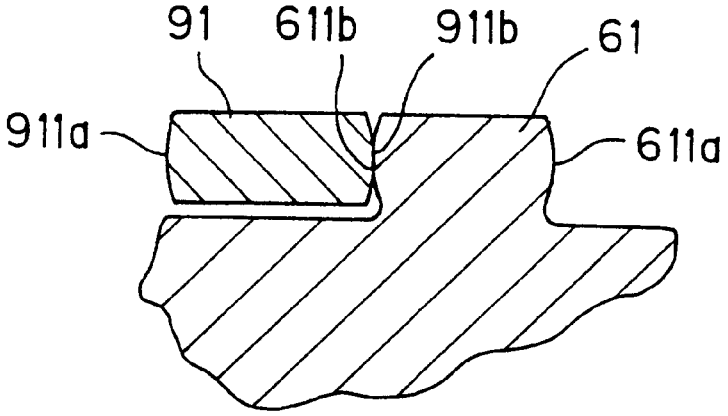
FIG. 8 is a cross-sectional view illustrating a contact condition of the pawl member with the wing member as shown in FIG. 7.

However, the contact of the pawl members 61, 61 with the wing members 91, 91 is not limited to the point contact as mentioned above. For example, the impact contacting areas 911*a*, 911*b*, 911*c*, 911*d* of the wing members 91, 91 may be formed into a flat surface without curving on an imaginary plane for cutting the wing members 91, 91, which is in parallel with a plane including the axial line of the bit holder 9, so that the pawl members 61, 61 can be brought into line contact with the wing members 91, 91. In the embodiment as shown in FIGS. 3 and 4, the impact contacting areas 911*a*, 911*b*, 911*c*, 911*d* of the wing members 91, 91 are curved. The present invention is not limited to the above-mentioned embodiment, and the impact contacting areas 611*a*, 611*b*, 611*c*, 611*d* of the pawl members 61, 61 may be curved as shown in FIGS. 5 and 6. The impact contacting areas 911*a*, 911*b*, 911*c*, 911*d* of the wing members 91 as well as the impact contacting areas 611*a*, 61*b*, 611*c*, 611*d* of the pawl members 61, 61 may be curved as shown in FIGS. 7 and 8.

Figure 9:
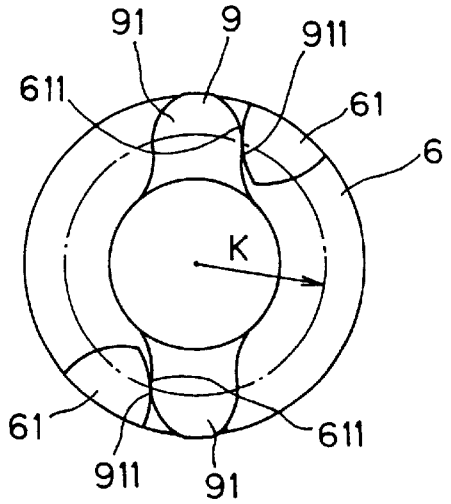
FIG. 9 is a view illustrating an embodiment in which the impact contacting areas are formed at a position corresponding to radius of gyration of the hammer body.
Figure 10:
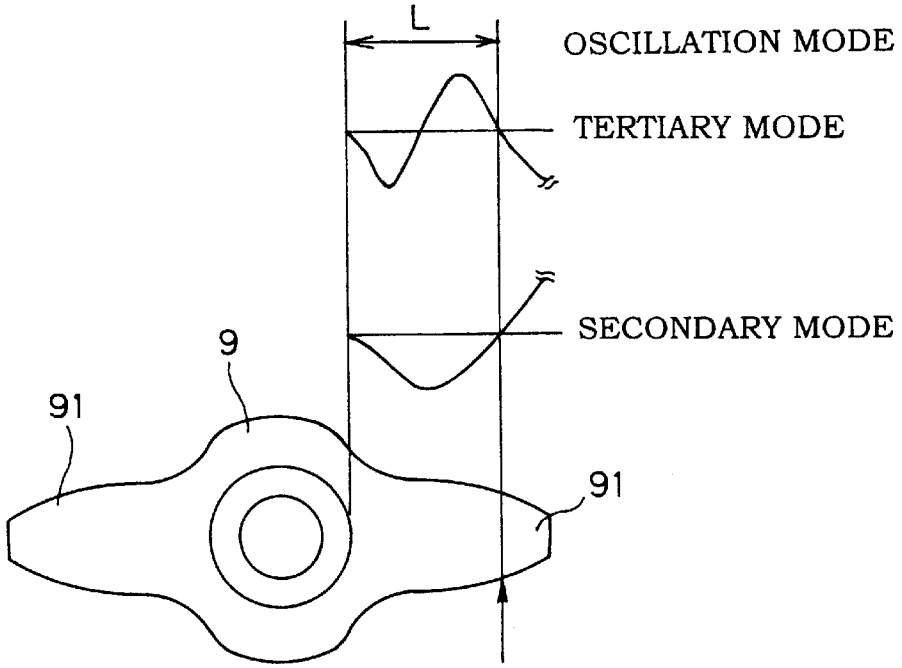
FIG. 10 is a view illustrating an embodiment in which the impact contacting areas are formed at a position corresponding to a node of oscillation mode of the wing member.

In a preferable embodiment, the pawl member 61 hits the wing member 91 at a position corresponding to radius of gyration of the hammer body 6 as shown in FIG. 9. More specifically, it is preferable to hit the pawl member 61 against the wing member 91 at a position remote from the center of the hammer body 6 by the distance expressed by the formula of $K=\sqrt{(I/M)}$ (where, K: radius of gyration, I: moment of inertia of the hammer body 6, M: mass of the hammer body 6). When the pawl member 61 hits the wing member 91 at the position corresponding to the radius of gyration in this manner, it is possible to transmit most effectively the rotational energy of the hammer body 6 to the bit holder 9.

In a further preferable embodiment, the hitting position of the pawl member 61 of the hammer body 6 against the wing member 91 coincides with the position corresponding to the radius of gyration of the hammer body 6, and in addition, the hitting position thereof coincides with a position L corresponding to a node of oscillation mode of the wing member 91, 91. The position L corresponding to the node of oscillation mode may preferably be a position corresponding to the node of the secondary or tertiary mode of oscillation. The above-mentioned arrangement is not limited to the secondary or tertiary mode of oscillation and the other degree mode of oscillation may be applied.

In view of elimination of impact noise during hitting, it is preferable to apply a surface hardening treatment such as a carburizing hardening method, a nitriding method and an induction hardening method to the hammer body 6 and the bit holder 9 without applying any heat treatment to the inside of them so that the inside thereof has a relatively low hardness. Such a treatment causes the inside of the hammer body 6 and the bit holder 9 to serve as a shock-absorbing member.

Another embodiment of the present invention will be described with reference to FIGS. 11 to 17.

In the other embodiment as shown in FIGS. 11 to 17, each of the wing members 91, 91 of the bit holder 9 is composed of a base part 92 and a contact piece 93 separately formed from the base part 92. The contact pieces 92, 92 are detachably secured to each of the base parts 92, 92.

Figure 11:
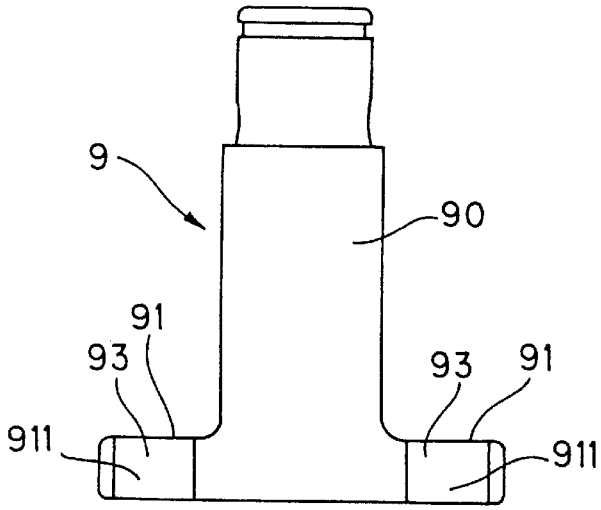
FIG. 11 is a side view of the bit holder to which contact pieces are detachably secured.
Figure 12:
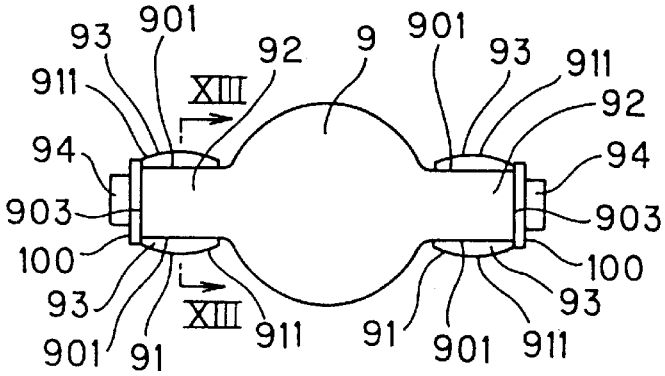
FIG. 12 is a bottom view of the bit holder as shown in FIG. 9.
Figure 13:
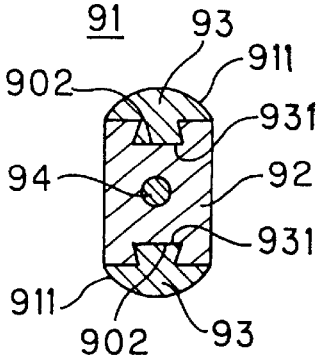
FIG. 13 is an enlarged cross-sectional view cut along the line XIII—XIII as shown in FIG. 10.

As shown in FIGS. 11 and 12, the bit holder 9 is composed of the holder body 90 having a cylindrical shape and two wing members 91, 91 formed at the rear end (i.e., the lower end in FIG. 11) of the holder body 90. The wing members 91, 91 extend in the diametrical direction so as to be symmetrical with respect to the center of the bit holder 9. The contact pieces 93, 93 are secured to the both side surfaces 901, 901 of the base part 92 of each of the wing members 91, 91, respectively.

The base part 92 is provided on its both side surfaces with dovetail grooves 902, 902 extending in the radius direction (i.e., the direction perpendicular to the drawing sheet of FIG. 13) of the bit holder 9. Each of the contact pieces 93, 93 is provided on its back surface with a dovetail tenon 931. The contact piece 93 has the impact contacting area 911, which is curved not only on an imaginary plane perpendicular to the axial line of the bit holder 9, but also on an imaginary plane for cutting the wing members 91, which plane is in parallel with a plane including the axial line of the bit holder 9.

The bottom width of the dovetail groove 902 is wider than the opening width thereof. The front end of the dovetail tenon 931 of the contact piece 93 is wider than the root end thereof. The contact piece 93 can be secured to the base part 92 by fitting the dovetail tenon 931 into the dovetail groove 902 in the radius direction of the bit holder 9 from the outside thereof and sliding the contact piece 93 along the side surface 901 in the radius direction of the bit holder 9 toward the inside thereof. The contact piece 93 can stationarily be secured to the base part 92 by fixing a retaining member 100 to the end surface 903 of the base part 92 by means of a screw 94.

Figure 14:
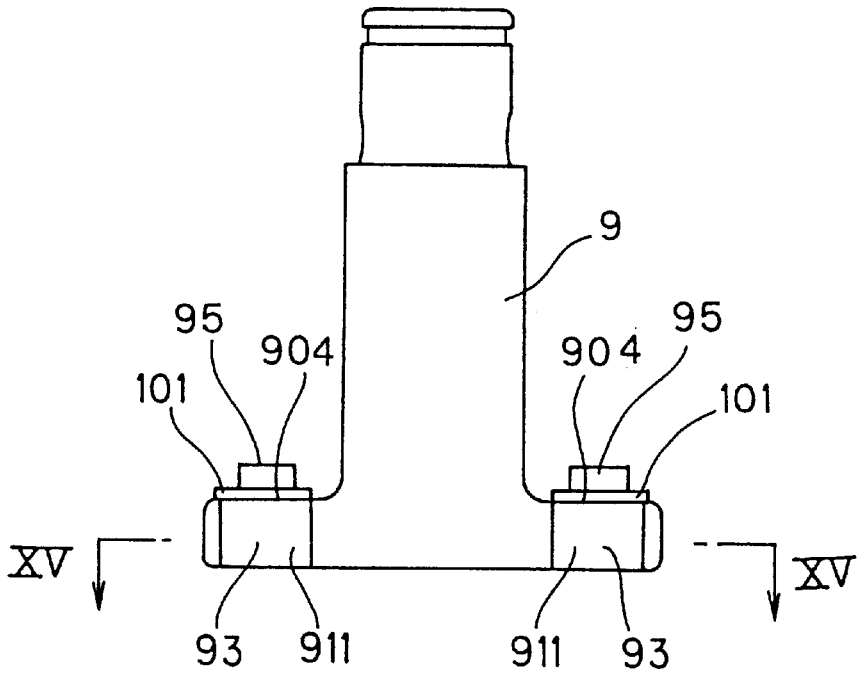
FIG. 14 is a side view of the bit holder of the other embodiment, which differs from the embodiment as shown in FIG. 11.
Figure 15:
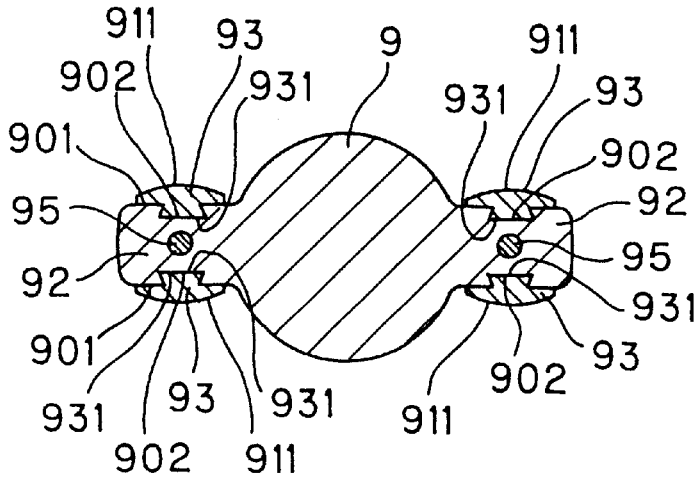
FIG. 15 is a cross-sectional view cut along the line XV—XV as shown in FIG. 14.

The dovetail grooves 901, 902 and the dovetail tenon 931, 931 may be formed so that the contact pieces 93 . . . 93 can slide from the front surface side of the base part 92 to the back surface side thereof (i.e., from the upper side to the lower side in FIG. 14) so as to be detachably secured to the base part 92. In the embodiment as shown in FIGS. 14 and 15, the dovetail grooves 902 . . . 902 are formed on the side surfaces 901 . . . 901 of the base part 92, 92 in the thickness direction of the base part 92, 92 (i.e., in the vertical direction in FIG. 14). One of the side opening ends of each of the dovetail grooves 902 . . . 902, which locates on the back surface of the base part 92, may preferably be closed so as to prevent the contact piece 93 from coming out from the back surface of the base part 92. Retaining members 101, 101 are fixed to the front surface 904, 904 of the base parts 92, 92 by means of screws 95, 95 so as to prevent the contact pieces 93 . . . 93 from coming out from the front surface 904, 904 of the base parts 92, 92.

Figure 16:
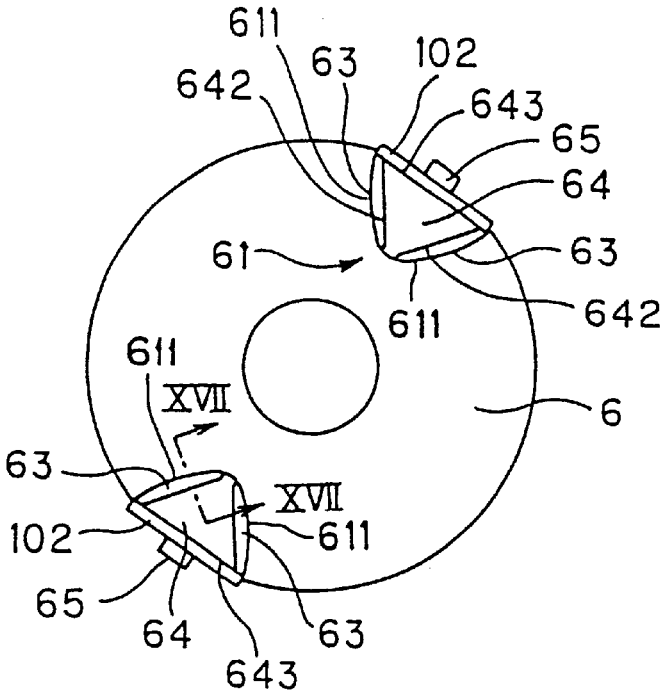
FIG. 16 is a front view of the hammer body having the pawl members in which the contact pieces are detachable.
Figure 17:
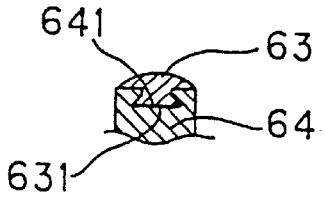
FIG. 17 is an enlarged cross-sectional view cut along the line XVII—XVII as shown in FIG. 16.

In FIGS. 16 and 17, the pawl member 61 of the hammer body 6 is divided into the contact pieces 63, 63 and the base part 64, and the contact pieces 63, 63 are detachably secured to the base part 64.

Each of the base parts 64, 64 has an isosceles triangle shape when the viewpoint locates at the front side of the hammer body 6. The base parts 64, 64 are formed on the front surface of the hammer body 6 so as to be symmetrical with respect to the center of the hammer body 6. Each of the base parts 64, 64 taper off to its inside end directing toward the center of the hammer body 6. The contact pieces 63 . . . 63 are secured to the side surfaces 642 . . . 642, which correspond to the isosceles of the base parts 64, 64. The contact pieces 63 . . . 63 are secured to the base parts 64, 64 by fitting the dovetail tenons 631 . . . 631 of the contact pieces 63 . . . 63 into the dovetail grooves 641 . . . 641 formed on the both side surfaces 642 . . . 642 of the base parts 64, 64 in the same manner as mentioned above.

The bottom width of the dovetail groove 641 is wider than the opening width thereof. The front end of the dovetail tenon 631 of the contact piece 63 is wider than the root end thereof so as to prevent the contact piece 63 from coming out from the base part 64 (see FIG. 17). The impact contacting area 611 of the contact piece 63 is also formed into a curved shape appearing on the side surfaces 642, 642 of the pawl members 61, 61. The dovetail grooves 641 . . . 641 are formed on the central portion in the thickness direction of the base part 64 (i.e., in the direction perpendicular to the drawing sheet of FIG. 17). One of the side opening ends of each of the dovetail grooves 641 . . . 641, which locates in the vicinity of the vertex of the isosceles triangle, directed toward the center of the hammer body 6, is closed.

Retaining members 102, 102 are fixed to the outside end surfaces 643, 643 of the base parts 64, 64 by means of screws 65, 65 so as to prevent the contact pieces 63 . . . 63 from coming out from the base parts 64, 64 under the function of centrifugal force.

The contact of the contact piece 63 of the pawl member 61 with the contact piece 93 of the wing member 91 is not limited to the point contact. The pawl member 61 and the wing member 91 may have flat surfaces in its thickness direction so that they can be brought into line contact with each other. In the preferable embodiment, the hitting position of the pawl member 61 and the wing member 91 coincides with the position corresponding to the radius of gyration of the hammer body 6, and in addition, the hitting position thereof coincides with a position corresponding to a node of oscillation mode of the wing member 91,91. It is also preferable to apply a surface hardening treatment such as a carburizing hardening method to the contact pieces 63, 93.

Figure 18:
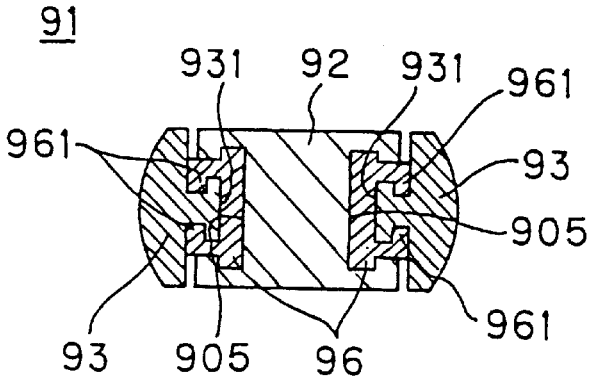
FIG. 18 is a cross-sectional view illustrating the wing members in which the contact pieces are secured to the base parts of the wing members through shock absorbing members.

Then, a further another embodiment of the present invention, which is provided with shock absorbing members 96, 96, will be described with reference to FIG. 18. In FIG. 18, the shock absorbing members 96, 96 are provided on the both side surfaces in the width direction (i.e., in the horizontal direction in FIG. 18) of the base part 92, respectively, so as to be held between the contact pieces 93, 93 and the base part 92.

The base part 92 of the wing member 91 is provided on the opposite surfaces in its width direction (i.e., in the horizontal direction in FIG. 18) with grooves 905, 905, so as to form an H-shape cross-section. The outer surface of the contact piece 93 is curved not only in the thickness direction (i.e., the vertical direction in FIG. 18) of the wing member 91, but also in the direction perpendicular to the above-mentioned thickness direction (i.e., the direction perpendicular to the drawing sheet of FIG. 18). The inner surface of the contact piece 93 is formed into a flat surface, on which an engaging portion 931 having a T-shape is formed.

The shock-absorbing member 96 has a pair of legs so as to form a U-shaped cross section. The legs are provided at their tip ends with inward hook portions 961, 961, which face each other. The shock absorbing member 96 is fitted to the contact piece 93 so as to embrace the engaging portion 931 thereof by engaging the hook portions 961, 961 with the engaging portion 931 of the contact piece 93.

The shock absorbing member 96 to which the contact piece 93 has been fitted, is inserted into the groove 905 of the base part 92 together with the engaging portion 931, so that the contact piece 93 is secured to the base part 92. When the shock absorbing member 96 is provided on the opposite sides with extended portions, which can engage with the base part 92, it is possible to prevent the shock absorbing member 96 from coming out from the base part 92. The present invention is not limited to the above-mentioned embodiment in which the shock absorbing members 96 are provided only in the wing member 91. The shock absorbing members 96 may be provided in the pawl member 61 of the hammer body 6, or in both of the wing member 91 and the pawl member 61.

Figure 19:
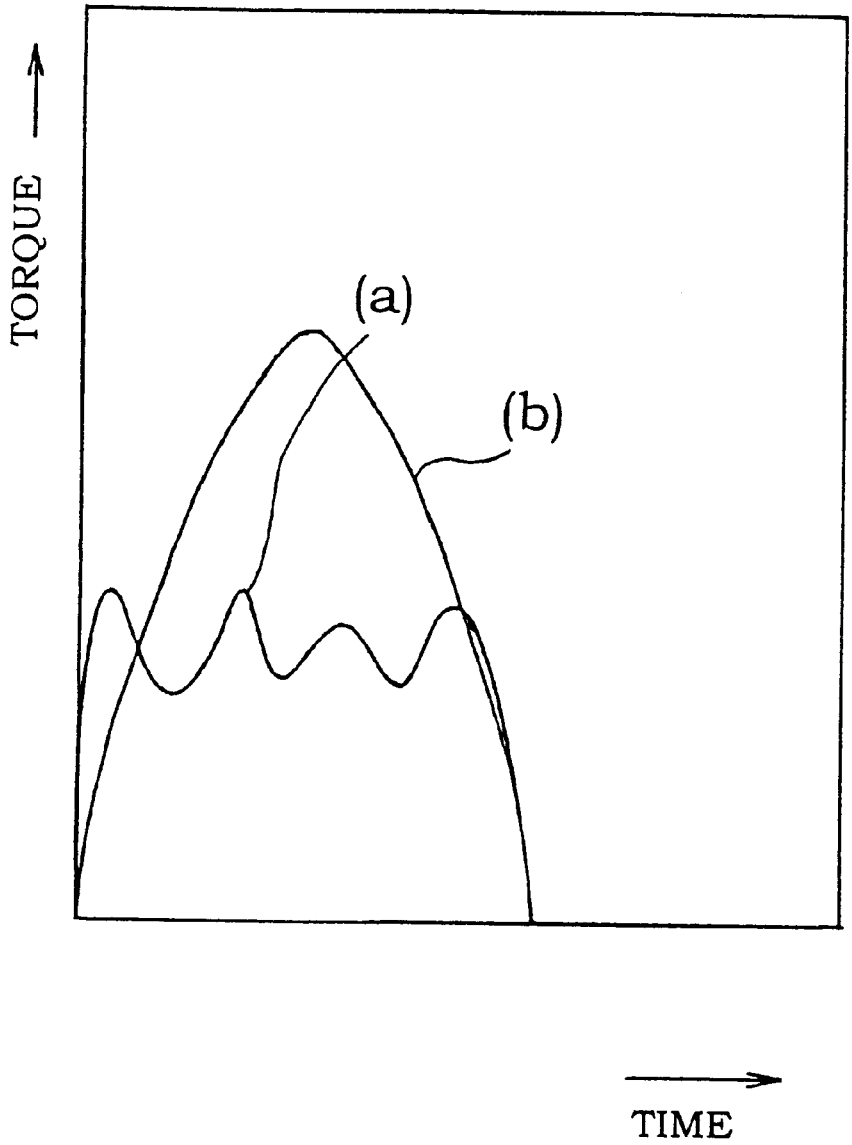
FIG. 19 is a view illustrating the contact time of the pawl member with the wing member of the present invention in comparison with the conventional impact structure.

FIG. 19 shows comparison results under the hitting condition between the conventional impact structure (a) and the impact structure (b) of one of the embodiments of the present invention, in which the impact contacting areas 611, 911 have curved projections and a carburizing hardening method has been applied. As is clear from the graph as shown in FIG. 19, in the conventional impact structure (a), an appropriate face contact does not occur, with the result that the hitting is made little by little. On the contrary, in the impact structure (b) of the present invention, the pawl member 61 can effectively hit the wing member 91.

In the above-described embodiment, the impact structure of the present invention is applied to the impact driver. However, the present invention is not limited to the above-described embodiment. The impact structure of the present invention may be applied to an impact wrench for fastening or unfastening a hexagonal head bolt.

According to the present invention as described in detail, since the impact contacting area of the pawl member can be brought into point-contact or line-contact with the impact contacting area of the wing member, it is possible to concentrate the hitting force on a single point or a single line so as to perform the transmission of the hitting force. Accordingly, the hitting force to be transmitted can be increased in comparison with the hammer body having the same mass. It is possible to use a small-sized hammer body without reducing a torque generated, thus leading to manufacture of a power tool having a small size and lightweight.

When the hitting position of the pawl member of the hammer body against the wing member 91 coincides with the position corresponding to the radius of gyration of the hammer body, it is possible to transmit most effectively the rotational energy of the hammer body to the bit holder. It is therefore possible to increase the hitting force without changing the size of the hammer body, and to use the hammer body having a small-size and light weight without reducing the hitting force.

In the present invention, when there is applied a structure that the pawl member of the hammer body hits the wing member at a node of oscillation mode of the wing member, unfavorable impact oscillation is not generated, thus leading to further improvement in transmission of the hitting force. Noise and vibration can also be reduced.

In the present invention, when the contact piece is formed as a separate body from the base part and is detachably secured to the base part, replacement of only the contact piece suffices upon its wear, thus making it possible to remarkably reduce the cost and time of period required for repair.

In the present invention, when the shock-absorbing member is provided on at least one of pawl member and the wing member, it is possible to extend the contact time of the pawl member and the wing member. Accordingly, the generated torque can be transmitted to the operation body for the long period of time. The shock-absorbing member has a cushion effect, thus making it possible to reduce noise during hitting.

What is claimed is:

1. An impact structure for an impact power tool, which comprises:

a hammer body rotatable by means of a driving actuator, said hammer body having at least one pawl member having an impact contacting area; and an operation body for rotating a bit for the impact power tool, said operation body having at least one wing member having an impact contacting area, which can be brought into contact with said impact contacting area of said pawl member;

said operation body being rotated by intermittently hitting said pawl member of said hammer body against said wing member of said operation body in a rotational direction of said hammer body;

wherein:

said impact contacting area of said pawl member can be brought into point-contact or line-contact with said impact contacting area of said wing member.

2. The impact structure for the impact power tool as claimed in claim 1, wherein:

said pawl member hits said wing member at a position corresponding to radius of gyration of said hammer body.

3. The impact structure for the impact power tool as claimed in claim 2, wherein:

said pawl member hits said wing member at a position corresponding to a node of oscillation mode of said wing member.

4. The impact structure for the impact power tool as claimed in claim 3, wherein:

at least one of said pawl member and said wing member comprises a contact piece having said impact contacting area and a base part to which said contact piece is to be fixed, and said contact piece is detachable from said base part.

5. The impact structure for the impact power tool as claimed in claim 4, wherein:

at least one of said pawl member and said wing member has a shock-absorbing member.

6. The impact structure for the impact power tool as claimed in claim 3, wherein:

at least one of said pawl member and said wing member has a shock-absorbing member.

7. The impact structure for the impact power tool as claimed in claim 2, wherein:

at least one of said pawl member and said wing member comprises a contact piece having said impact contacting area and a base part to which said contact piece is to be fixed, and said contact piece is detachable from said base part.

8. The impact structure for the impact power tool as claimed in claim 7, wherein:

at least one of said pawl member and said wing member has a shock-absorbing member.

9. The impact structure for the impact power tool as claimed in claim 2, wherein:

at least one of said pawl member and said wing member has a shock-absorbing member.

10. The impact structure for the impact power tool as claimed in claim 1, wherein:

at least one of said pawl member and said wing member comprises a contact piece having said impact contacting area and a base part to which said contact piece is to be fixed, and said contact piece is detachable from said base part.

11. The impact structure for the impact power tool as claimed in claim 10, wherein:

at least one of said pawl member and said wing member has a shock-absorbing member.

12. The impact structure for the impact power tool as claimed in claim 1, wherein:

at least one of said pawl member and said wing member has a shock-absorbing member.

* * * * *